US005853933A

United States Patent [19]

Duff et al.

[11] Patent Number: 5,853,933

[45] Date of Patent: Dec. 29, 1998

[54] PHOTOCONDUCTIVE MEMBER AND PERYLENE PROCESSES

[75] Inventors: James M. Duff; Ah-Mee Hor, both of Mississauga; C. Geoffrey Allen, Waterdown, all of Canada

[73] Assignee: Xerox Corporation, Stamford, Conn.

[21] Appl. No.: 867,595

[22] Filed: Jun. 2, 1997

[51] Int. Cl.[6] ..... G03G 5/047

[52] U.S. Cl. ..... 430/59; 549/232

[58] Field of Search ..... 430/59, 58, 71, 430/72, 78; 549/232

[56] References Cited

U.S. PATENT DOCUMENTS

| | | | |
|---|---|---|---|
| 4,265,990 | 5/1981 | Stolka et al. | 430/59 |
| 4,299,897 | 11/1981 | Stolka et al. | 430/59 |
| 4,429,029 | 1/1984 | Hoffmann et al. | 430/57 |
| 4,460,410 | 7/1984 | Spietschka et al. | 549/232 |
| 4,501,906 | 2/1985 | Spietschka et al. | 549/232 |
| 4,514,482 | 4/1985 | Loutfy et al. | 430/78 |
| 4,609,605 | 9/1986 | Lees et al. | 430/58 |
| 4,968,571 | 11/1990 | Gruenbaum et al. | 430/58 |
| 5,019,473 | 5/1991 | Nguyen et al. | 430/58 |
| 5,225,307 | 7/1993 | Hor et al. | 430/136 |
| 5,683,842 | 11/1997 | Duff et al. | 430/54 |

*Primary Examiner*—John Goodrow
*Attorney, Agent, or Firm*—E. O. Palazzo

[57] ABSTRACT

A process for the preparation of perylene tetracarboxylic acid dianhydride comprising the dissolution thereof in an aqueous alkaline solution, or optionally an amine solution; converting the salt formed to the corresponding tetracarboxylic acid of said perylene tetracarboxylic dianhydride; heating the resulting tetracarboxylic acid; washing the dianhydride formed until the filtrate pH indicates substantially complete removal of the acid; and drying said dianhydride.

19 Claims, No Drawings

PHOTOCONDUCTIVE MEMBER AND PERYLENE PROCESSES

PENDING APPLICATIONS

Illustrated in U.S Pat. No. 5,645,965 and U.S. Pat. No. 5,683,842 are photoconductive imaging members with symmetrical or unsymmetrical perylenes. The disclosures of each of these applications are totally incorporated herein by reference in their entireties.

BACKGROUND OF THE INVENTION

The present invention is directed generally to photoresponsive imaging members, and more specifically, to photoconductive imaging members comprised of certain perylene photogenerating pigments. In embodiments, the present invention is directed to processes for the purification of perylene tetracarboxylic acid dianhydrides and methods for the preparation of perylene bisimide photogenerating pigments therefrom in a form and purity, which is suitable for direct use in the fabrication of photoreceptor binder/generator layers (BGLs) without the need for subjecting the perylene photogenerating pigments to further purification process, such as solvent extraction, acid pasting or vacuum evaporation. In embodiments the present invention is directed to an imaging member comprised of a supporting substrate, a photogenerating layer comprised of a perylene bisimide photogenerating pigment obtained from purified perylene tetracarboxylic acid dianhydride and a charge, especially hole, transport layer. Imaging members with the photogenerating pigments of the present invention are sensitive to wavelengths of from about 400 to about 700 nanometers, that is throughout the visible region of the light spectrum, and exhibit excellent xerographic electrical properties such as high charge acceptance, low dark decay, stable cycling characteristics and low sensitivity to environmental effects such as changing temperature and relative humidity. In embodiments thereof, the imaging members of the present invention generally possess broad spectral response to white light and lower dark decay characteristics as illustrated herein.

PRIOR ART

Generally, layered photoresponsive imaging members are described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

The use of selected perylene pigments as photoconductive substances is also known. There is thus described in Hoechst European Patent Publication 0040402, DE3019326, filed May 21, 1980, the use of N,N'-disubstituted perylene-3,4,9,10-tetracarboxyidiimide pigments as photoconductive substances. Specifically, there is, for example, disclosed in this publication N,N'-bis(3-methoxypropyl)perylene-3,4,9,10-tetracarboxyl diimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers.

Moreover, there are disclosed in U.S. Pat. No. 4,419,427 electrographic recording media with a photosemiconductive double layer comprised of a first layer containing charge carrier perylene diimide dyes dispersed in a polymeric binder and a second layer with one or more compounds which are charge transporting materials when exposed to light, reference the disclosure in column 2, beginning at line 20.

The two general types of perylene pigment, illustrated as follows are commonly referred to as perylene bis(imides) and bis(imidazo) perylenes.

FORMULA 1
Photoconductive Perylene Pigments from Perylene-3,4,9,10-Tetracarboxylic Acid Dianhydride

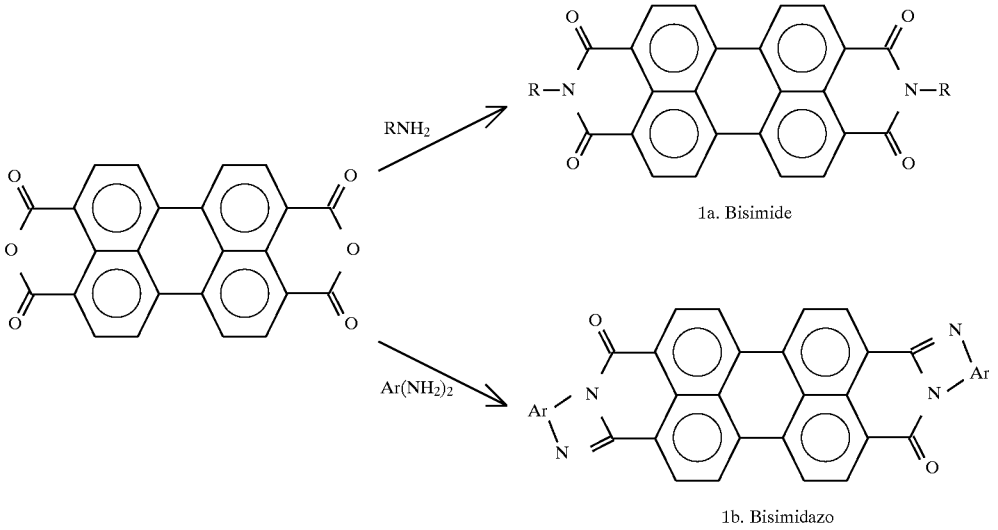

Formula 1. Perylene bisimide (1a) and bisimidazo (1b) pigments. R = alkyl, aryl, aralkyl etc; Ar = 1,2-phenylene,1,8-naphthalene and the like.

Perylenes with these general structures can be prepared by reacting perylene tetracarboxylic acid dianhydride with primary amines or with diamino-aryl or -alkyl compounds. In U. S. Pat. No. 3,871,882, there is disclosed the use of the perylene dianhydride and bisimides in general (1a, R=H, lower alkyl ($C_1$ to $C_4$), aryl, substituted aryl, aralkyl, a heterocyclic group or the NHR' group in which R' is phenyl, substituted phenyl or benzoyl) as vacuum evaporated thin charge generation layers (CGLs) in photoconductive devices coated with a charge transporting layer (CTL). In U.S. Pat. No. 3,904,407, the disclosure of which is totally incorporated herein by reference, there is illustrated the use of general bisimide compounds (1a, R=alkyl, aryl, alkylaryl, alkoxyl or halogen, or heterocyclic substituent) with preferred pigments being R=chlorophenyl or methoxyphenyl. This patent illustrates the use of certain vacuum evaporated perylene pigments or a highly loaded dispersion of pigments in a binder resin (BGL) as CGL in layered photoreceptors with a CTL overcoat or, alternatively, as a single layer device in which the perylene pigment is dispersed in a charge transporting active polymer matrix. The use of purple to violet dyestuffs with specified chromaticity values, including bisimidazo perylenes, specifically cis and trans bis(benzimidazo)perylene (1b, X=1,2-phenylene) and bis(1,8-naphthimidazoa)perylene (1b, X =1,8-naphthylyl), is disclosed in U.S. Pat. No. 3,972,717. This patent also describes the use of vacuum-evaporated CGLs in layered photoconductive devices. The use of a plurality of pigments, inclusive of perylenes, in vacuum evaporated CGLs is illustrated in U.S. Pat. No. 3,992,305.

U.S. Pat. No. 4,419,427 describes the use of highly-loaded dispersions of perylene bisimides, with bis(2,6-dichlorophenylimide) being a preferred material, in binder resins as CGL layers in devices overcoated with a charge transporting layer such as a poly(vinylcarbazole) composition. According to this patent, the bisimide may be prepared in a known manner by condensation.

U.S. Pat. No. 4,429,029 illustrates the use of bisimides and bisimidazo perylenes in which the perylene nucleus is halogenated, preferably to an extent where 45 to 75 percent of the perylene ring hydrogens have been replaced by halogen. U.S. Pat. No. 4,587,189, the disclosure of which is totally incorporated herein by reference, describes layered photoresponsive imaging members prepared using highly-loaded dispersions or, preferably, vacuum evaporated thin coatings of cis- and trans-bis(benzimidazo)perylene (Formula 1, 1b, X=1 ,2-phenylene) and other perylenes overcoated with hole transporting compositions comprised of a variety of N,N,N',N'-tetraaryl-4,4'-diaminobiphenyls. It is indicated in this patent that vacuum-evaporated perylene pigment photogenerator layers have significantly higher photosensitivity than BGL photogenerator layers prepared using pigment dispersed in binder resins. U.S. Pat. No. 4,937,164 illustrates the use of perylene bisimides and bisimidazo pigments in which the 1,12- and/or 6,7 position of the perylene nucleus is bridged by 1 or 2 sulfur atoms wherein the pigments in the CGL layers are either vacuum evaporated or dispersed in binder resins in similar devices incorporating tetraaryl biphenyl hole transporting molecules. Similarly, in U.S. Pat. No. 4,719,163 and U.S. Pat. No. 4,746,741 vacuum evaporated layers of the pigment N,N'-bis(2-(3-methylphenyl)ethyl)perylene-3,4,9,10-bis(dicarboximide) (1a, R=3-methyl-phenethyl) are indicated as providing layered electrophotographic devices having spectral response to beyond 675 nanometers.

Perylene pigments, which are unsymmetrically substituted, have also been used as CGL (charge generating layers) materials in layered photoreceptors. The preparation and applications of these pigments, which can be either bis(imides) in which the imide nitrogen substituents (R in Formula 1a) are different or have monoimide-monoimidazo structures (i.e. one half of the molecule has the la type structure and the other half has the 1b type structure) is described in U.S. Pat. No. 4,501,906. In U.S. Pat. No. 4,968,571, there is illustrated the use of a number of unsymmetrical substituted perylenes with one phenethyl radical bonded to the imide nitrogen atom.

Two additional patents relating to the use of perylene pigments in layered photoreceptors are U.S. Pat. No. 5,019,473 which illustrates a grinding process to provide finely and uniformly dispersed perylene pigment in a polymeric binder with excellent photographic speed, and U.S. Pat. No. 5,225,307, the disclosure of which is totally incorporated herein by reference, which discloses a vacuum sublimation process which provides photoreceptor pigment, such as bis(benzimidazo)perylene (1b, X=1,2 -phenylene) with superior electrophotographic performance compared to unpurified or "as-synthesized" pigment.

The following patents and publications relate to the use of perylene compounds, either as dissolved dyes or as dispersions in single layer electrophotographic photoreceptors usually based on sensitized poly(vinyl carbazole) compositions: U.S. Pat. Nos. 4,469,769; 4,514,482; 4,556,622; Japanese JP 84-31,957, -119,356, -119,357, -140,454, -140,456, -157,646, -157,646, and -157,651.

Although known imaging members and processes thereof are suitable for their intended purposes, a need remains for imaging members containing certain perylenes obtained from tetracarboxylic acid dianhydrides. In addition, a need exists for imaging members containing photoconductive materials with improved xerographic electrical performance including higher charge acceptance, lower dark decay, increased charge generation efficiency and charge injection into the transporting layer, tailored PIDC curve shapes to enable a variety of reprographic applications, reduced residual charge and/or reduced erase energy, improved long term cycling performance, and less variability in performance with environmental changes in temperature and relative humidity. There is also a need for imaging members with photoconductive materials comprised of certain perylene photogenerating pigments with enhanced dispersability in polymers and solvents. There is also a need for photogenerating pigments which allow the preparation of coating dispersions, particularly in dip-coating operations, which are colloidally stable, and wherein settlement is avoided or minimized, for example little settling for a period of from 20 to 30 days in the absence of stirring. Further, there is a need for photoconductive materials with enhanced dispersability in polymers and solvents that enable low cost coating processes in the manufacture of photoconductive imaging members. Additionally, there is a need for photoconductive materials that enable imaging members with enhanced photosensitivity in the red and infrared wavelength regions of the light spectrum, enabling the resulting imaging members thereof to be selected for LED xerographic imaging processes and printers, and diode laser printer and imaging apparatuses. There is also a need for photogenerator pigments with spectral response in the blue and green regions of the spectrum which can be tailored to the newly emerging nitride diode lasers. A need also exists for improved panchromatic pigments with broad white light response from about 400 to about 700 nanometers for color copying using light-lens processes.

While these needs may be obtainable by the many types of perylene bisimide pigments described herein, it is generally observed that the best overall xerographic electrical performance, for example, high charge acceptance, low dark decay, high photosensitivity, low residual voltage, extended lifetimes and insensitivity to changes in environmental effects, such as temperature and relative humidity, may be present with devices in which the charge generator layer is prepared by vacuum evaporation. Generally, devices in which the generator layer (BGL) is prepared by solvent coating a dispersion of finely divided perylene pigment in a polymer binder may evidence poorer overall xerographic electrical performance. This can be attributed mainly to the vacuum evaporation process which results in the purification of the pigment by removing any nonvolatile contaminants and by "pumping off" more volatile contaminants which may have been present in the "as-synthesized" pigment. (Reference, U.S. Pat. No. 5,225,307 and J. Duff et al. in SPIE Proceedings, Vol. 1253, *Hard Copy and Printing Materials, Media and Process* (1990), page 183). However, solvent coating of a pigment dispersion is usually preferable from a cost and manufacturability standpoint to vacuum deposition of the photogenerator layer, particularly in modern OPC plants all of which use dip coating processes.

To improve the performance of as-synthesized material there may be selected a vacuum sublimation process to purify the pigment and use the sublimed material to prepare a BGL coating as is described, for example, in U.S. Pat. Nos. 4,514,482 and 5,225,307. However, although this method can afford substantially pure pigment which exhibits improved overall xerographic electrical properties compared to as-synthesized material, it is costly and difficult to scale up to large quantities (i.e. greater than 1 Kg). Furthermore, sublimation generally results in large crystals of pigment which require prolonged grinding of the coating formulation to reduce them to the submicron size generally required for an effective BGL. It is an important object of this invention to provide chemical purification processes and synthetic methods which afford perylene bisimide pigments in high purity which are suitable for the preparation of BGL (binder generator layer) coatings without the need for vacuum evaporation or other pigment prepurification.

SUMMARY OF THE INVENTION

Examples of objects of the present invention include:

It is an object of the present invention to provide imaging members and processes with many of the advantages illustrated herein.

It is another object of the present invention to provide imaging members with photoconductive components with improved photoconductivity.

It is another object of the present invention to provide photoconductive imaging members with perylene bisimide photogenerating pigments that enable imaging members with enhanced photosensitivity from the visible to the near infrared wavelength regions of the light spectrum, such as from about 400 to about 700 nanometers.

It is another object of this invention to provide processes for the purification of perylene tetracarboxylic acids and therefrom perylene bisimides photogenerating pigments.

Another object of the present invention relates to the preparation of perylene bisimide photogenerating pigments from 3,4,9,10-perylene tetracarboxylic acid dianhydride, and which pigments are suitable for direct application as the BGL photogenerator pigment in layered photoconductive imaging members without the need for prepurification by, for example, vacuum sublimation or wet chemical processes. These and other disadvantages are avoided with the invention of the present application in embodiments thereof.

In embodiments the present invention relates to layered imaging members comprised of a supporting substrate, a photogenerating layer comprised of photogenerating pigments comprised of perylene compounds, and more specifically, perylene bisimides of the formulae illustrated herein. The perylene bisimides can be prepared in accordance with embodiments of the present invention by the dissolution of, for example, 3,4,9,10-perylene tetracarboxylic acid dianhydride in an aqueous alkali salt, such as potassium hydroxide, solution; filtration of the resultant solution of the tetracarboxylic acid salt through a fine filter like a Whatman Glass fiber filter grade GF/F, to remove colloidal black contaminants usually present in an amount of from about 0.5 to about 1 weight percent of the anhydride; reconverting the salt formed, such as the potassium salt, to the corresponding anhydride by acidifying the solution with an acid, such as hydrochloric acid, and heating the resulting suspension to form the anhydride; filtering and washing the anhydride formed with deionized water until the filtrate pH indicates complete removal of the acid; and freeze drying the wet filter cake to provide the pure desired anhydride powder.

The process of the present invention in embodiments comprises stirring 3,4,9,10-perylene tetracarboxylic acid dianhydride in an amount of, for example, from 1 part to about 20 parts by weight in from about 99 to about 80 parts by weight of water containing a base such as an alkali metal hydroxide, like lithium hydroxide, sodium hydroxide, potassium hydroxide; or a tertiary organic amine, especially a primary amine, and more specifically, triethylamine or triethanolamine in an amount corresponding to, for example, from 4 to about 10 molar equivalents of the dianhydride for a period of, for example, from about 2 to about 48 hours at a temperature of, for example, from about 0° C. to about 95° C. (Centigrade) until the acid is converted to its soluble tetracarboxylate salt form. This is followed by filtration of the resultant solution through, for example, a fine filter medium, such as Whatman Glass Fibre filter, grade GF/F 934AH, may not be fine enough unless, for example, a filter aid is used which removes black colloidal contaminants from the solution and which are present, for example, in an amount corresponding to about 0.5 to 1.5 percent of the crude dianhydride. The product resulting has not been identified but it appears to be inorganic product with iron, calcium and silicon identified as the major elemental components by Energy Dispersive X-ray Analysis (EDXA). This filtration is slow requiring, for example, as much as 8 hours to filter 1 liter of solution containing the salt from about 100 grams of the dianhydride through a 15 centimeter diameter filter. Optionally, a filter aid, such as Celite 521, in an amount of from about 0.1 part to about 1 part by weight of the starting dianhydride can be added to the solution prior to filtration. The use of such a filter aid can increase the speed of the filtration by a factor of, for example, about 8 (i.e. from 8 hours to 1) compared to filtration without the aid and also enables the use of a coarser less expensive filter medium, such as Whatman Grade 934AH glass fiber. Following filtration, the solid contaminant and filter aid is washed with about 5 to about 20 parts of water.

The resultant dark yellow brown solution of the acid salt is then stirred and heated to a temperature of from about 25° C. to about 95° C., followed by treatment with a strong aqueous acid, such as hydrochloric acid, sulfuric acid or phosphoric acid, in an amount corresponding to from an equimolar amount to about two molar equivalents of the base that was initially used to dissolve the dianhydride. This causes the formation of a very thick red suspension of the perylene tetracarboxylic acid. The suspension is then stirred and heated at a temperature of, for example, from about 75° C. to about 100° C. for a period of, for example, from about 10 minutes to about 2 hours which causes the tetra acid to convert to the dianhydride. The resulting suspension is then cooled to a temperature of, for example, from about 25° C. to about 80° C. and is filtered using a glass fiber filter or a fine porosity sintered glass filter funnel. The resulting solid is then washed in the funnel with deionized water, which water is selected in an amount of, for example, from about 100 to about 400 parts until the acid is removed as indicated by the pH of the filtrate achieving a value of, for example, from 6 to 6.5 as measured using pH paper and is dried. The yield of purified anhydride ranges, for example, from about 90 percent to about 97 percent. Optionally, following the final water wash, the resulting wet cake can be washed with a more volatile solvent, such as methanol, acetone and the like, which will increase the drying process, or preferably, the water-washed wet cake can be freeze-dried using, for example, a commercially available freeze drier. This process affords the dianhydride as a fine, flowing powder which is free of hard lumps and which disperses readily in organic solvents, and which product may be used for subsequent reactions such as the preparation of photogenerating bisimide pigments. The final product is highly pure, for example greater than about 99 percent, undergoing a weight loss of about 0.5 percent, measured by thermogravimetric analysis, when a sample thereof, such as a 10 milligram sample, is heated to 400° C. Analysis of a typical purified sample indicates about 370 ppm of sulfur and 65 ppm of iron compared to 2,600 ppm of sulfur and about 1,300 ppm of iron in the original crude dianhydride.

The perylene tetracarboxylic acid dianhydride resulting can then be selected to prepare bisimide perylene by, for example, the reaction of from 1 to about 20 parts of the dianhydride with from about 2 to about 10 mole equivalents of a primary alkyl, aryl or aralkylamine in from about 99 to about 80 parts of a hot solvent, such as boiling N-methylpyrrolidine (NMP) for a period of from about 10 minutes to about 4 hours to provide, after cooling, the bisimide. In situations where the bisimide is insoluble in the boiling NMP, as evidenced by the presence of crystalline solid in the reaction mixture, the suspension is cooled to about 150° C. to 160° C. and filtered through a filter funnel which has been preheated with a small amount of boiling dimethylformamide (DMF). The solid is washed in the funnel portionwise with boiling DMF in an amount of from about 50 parts to about 200 parts depending on the particular bisimide being washed. The initial filtrate and first boiling DMF wash filtrate are normally a deep dark reddish brown color which is attributed to the presence of unknown soluble reaction byproducts. Successive washes with boiling DMF result in the filtrate color changing to nearly colorless or to a light orange color which is indicative of a minor amount of dissolved bisimide. The solid is then washed with about 50 parts of cold DMF followed by 3 portions of about 25 parts each of methanol and is dried in air or under vacuum at a temperature of from about 60° C. to about 150° C. for from about 1 hour to about 4 days. The yield of isolated perylene bisimide ranges, for example, from about 80 percent to about 95 percent. The purity of the material could be ascertained by elemental analysis and by proton nuclear magnetic resonance spectroscopy. In situations where the bisimide is soluble or partly soluble in hot NMP, the reaction mixture is cooled and stirred until crystals of bisimide are seen in the solution. The mixture is then cooled a further 30 to 50 degrees below the temperature at which crystals are observed and is filtered. The resulting solid is washed with DMF heated to the filtration temperature until the color of the filtrate becomes light orange as above. Other reaction parameters not specifically recited may also be selected in embodiments.

A number of the perylene bisimide pigments prepared together with filtration temperatures and product yields is provided in Table 1.

TABLE 1

Bisimides Synthesized Using Perylene Tetracarboxylic Acid Dianhydride (PTCDA) "R-Group" Refers to Formula 1a. All Reactions were carried out in NMP Unless noted.

| R-Group | Example | PTCDA | Equivalents of amine | Reflux Time (min) | Filtration Temperature | % Yield |
|---|---|---|---|---|---|---|
| n-Propyl | Synthesis 1 | Purified | 5 | 35 | 150 | 86 |
| " | Comp. Synth. 1 | Crude | 5 | 5 | 150 | 91 |
| 3-Methoxypropyl | Synthesis 2 | Purified | 5 | 90 | 150 | 84 |
| " | Comp. Synth. 2 | Crude | 7.5 | 5 (DMF) | 150 | 91 |
| n-Pentyl | Synthesis 3 | Purified | 5 | 30 | 120 | 82 |
| " | Comp. Synth. 3 | Crude | 11 | 30 | 150 | 60 |
| Benzyl | Synthesis 4 | Purified | 5 | 60 | 150 | 91 |
| " | Comp. Synth. 4 | Crude | 5 | 60 | 150 | 91 |
| 3-Chlorobenzyl | Synthesis 5 | Purified | 3 | 30 | 150 | 91 |
| " | Comp. Synth. 6 | Crude | 5 | 5 | 155 | 93 |
| 3-Methoxybenzyl | Synthesis 6 | Purified | 5 | 110 | 150 | 92 |
| " | Comp. Synth. 6 | Crude | 5 | 110 | 150 | 94 |
| 4-Methoxybenzyl | Synthesis 7 | Purified | 5 | 40 | 150 | 97 |
| " | Comp. Synth. 7 | Crude | 7.3 | 45 | 150 | 97 |
| Phenethyl | Synthesis 8 | Purified | 5 | 30 | 150 | 91 |

In embodiments, the imaging members of the present invention are comprised of, in the order indicated, a conductive substrate, a photogenerating layer comprising the bisimide perylene photogenerating pigments, and a charge transport layer, which comprises charge transporting molecules dispersed in an inactive resinous binder composition.

In another embodiment, the photoconductive imaging member comprises a conductive substrate, a hole transport layer comprising a hole transport composition, such as an aryl amine, dispersed in an inactive resinous binder composition, and as a top layer a photogenerating layer comprising the bisimide perylene photogenerating pigment optionally dispersed in a resinous binder composition; or a conductive substrate, a hole blocking metal oxide layer, an optional adhesive layer, a photogenerating layer comprised of the bisimide perylene photogenerating pigment of the present invention or mixtures thereof, optionally dispersed in a resinous binder composition, and an aryl amine hole transport layer comprising aryl amine hole transport molecules optionally dispersed in a resinous binder.

Embodiments of the present invention include a process for the preparation of perylene tetracarboxylic acid dianhydride comprising the dissolution thereof in an aqueous alkaline solution, or optionally an amine solution; converting the salt formed to the corresponding tetracarboxylic acid of said perylene tetracarboxylic dianhydride; heating the resulting tetracarboxylic acid; washing the dianhydride formed until the filtrate pH indicates substantially complete removal of the acid; and drying said dianhydride; a process wherein dissolution is in an aqueous alkaline solution, thereafter heating the resulting aqueous suspension of the tetracarboxylic acid; washing the dianhydride formed with water until the filtrate pH indicates substantially complete removal of the acid; and freeze drying the resulting dianhydride wet filter cake to provide a substantially pure perylene tetracarboxylic acid dianhydride powder; a process for the purification of 3,4,9,10-perylene tetracarboxylic acid dianhydride comprising the dissolution of said acid dianhydride in an aqueous alkali metal hydroxide solution at from about 25° C. to about 90° C.; filtration of the resultant solution through a fine porosity filter with a pore size of from about 0.1 to about 1 micron, primarily to remove colloidal black contaminants present in an amount of from about 0.5 to about 1.5 weight percent of the dianhydride; converting the alkali metal salt formed to 3,4,9,10-perylene tetracarboxylic acid by acidifying the solution with hydrochloric acid, and thereafter heating the resulting suspension at from about 75° C. to about 100° C. to form 3,4,9,10-perylene tetracarboxylic acid dianhydride; filtering and washing the anhydride formed with water until the filtrate pH is from about 6 to about 7 and which pH indicates complete removal of the acid; and freeze drying the resulting wet filter cake to provide substantially pure 3,4,9,10-perylene tetracarboxylic acid dianhydride; a process wherein prior to said filtration of the resultant solution there is added to said solution a suitable filter component; a process wherein the dianhydride is present in an amount of from about 2 parts to about 30 parts, the water is present in an amount of from about 98 parts to about 70 parts, the alkali metal hydroxide is potassium hydroxide present in an amount corresponding to from about 3 molar equivalents to about 10 molar equivalents of the dianhydride and the hydrochloric acid is added from about an equimolar amount to about 4 molar equivalents of the potassium hydroxide; a process wherein the dianhydride is present in an amount of from about 10 parts to about 20 parts, the water is present in an amount of from about 90 parts to about 80 parts, the alkali metal hydroxide is potassium hydroxide present in an amount corresponding to from about 4 molar equivalents to about 5 molar equivalents of the dianhydride and the hydrochloric acid is selected in an amount of from about one molar equivalent to about 2 molar equivalents of the potassium hydroxide; a process wherein the alkali metal hydroxide is potassium hydroxide, sodium hydroxide, or lithium hydroxide; a process wherein the amine is selected and is a tertiary organic amine of trimethylamine, triethylamine or tripropylamine; a process wherein the dissolution of the dianhydride in the aqueous alkali solution is accomplished at a temperature of from about 25° C. to about 90° C. over a time of from about 15 minutes to about 24 hours, and wherein said alkali solution contains potassium hydroxide; a process wherein the tetracarboxylic acid is converted to the dianhydride by heating the tetracarboxylic acid in suspension at a temperature of from about 75° C. to about 100° C. for a period of from about 15 minutes to about 8 hours; a process wherein the purity of the product is from about 98 percent to about 99.4 percent there being no detectable ash measured by combustion analysis, and wherein the amount of volatile contaminants released when a sample of said product is heated to about 400° C. as measured by thermogravimetric analysis is less than about 0.6 percent; a process wherein the product contains from 0 to about 500 ppm of sulfur and from 0 to about 100 ppm of iron; a process wherein the product contains from 0 to about 500 ppm of sulfur and from 0 to about 100 ppm of iron; a process wherein said perylene tetracarboxylic acid dianhydride is perylene-3,4,9,10-tetracarboxylic acid dianhydride and is reacted with a primary amine in a refluxing high boiling reaction solvent, followed by filtering the resultant bisimide; washing the product with hot wash solvent which solvent is at a temperature of from about 60° C. to about 155° C.; washing the resulting solid with a low boiling final wash solvent, which solvent possesses a boiling point of from about 50° C. to about 80° C., and drying the product; a process wherein the anhydride is present in an amount of from about 1 part to about 20 parts, the refluxing reaction solvent is present in an amount of from about 99 to about 80 parts, and the primary amine is present in an amount corresponding to about 2 to about 20 equivalents of the anhydride, or wherein the anhydride is present in an amount of from about 2 part to 5 parts, the reaction solvent is present in an amount of from about 98 to about 95 parts, and the primary amine is present in an amount corresponding to about 2.5 to about 5 equivalents of the anhydride; a process wherein the reaction solvent is dimethylformamide, or N-methylpyrrolidone, the hot wash solvent is dimethylformamide wherein hot is at a temperature of from about 60° C. to about 155° C., and wherein the final wash solvent is methanol; a process wherein the amine is n-propylamine, 3-methoxypropylamine, 3-chlorobenzylamine, 3-methoxybenzylamine, 4-methoxybenzylamine, 2-phenethylamine, 3,5-dimethylbenzylamine, or 3,5-dichlorobenzylamine; a process wherein subsequent to washing the resulting solid with a low boiling final wash solvent, which solvent possesses a boiling point of from about 50° C. to about 80° C., cooling is accomplished and the product is perylene-3,4,9,10-tetracarboxylic acid dianhydride; a process wherein there results a high purity product, and which purity is from about 98 to about 99.8 percent; a photoconductive imaging member comprised of a photogenerating layer comprised of a perylene bisamide obtained from a perylene tetracarboxylic acid dianhydride and which dianhydride is prepared by the dissolution of perylene tetracarboxylic acid dianhydride in an aqueous alkaline solution, or optionally an amine solution; converting the salt formed to the corresponding tetracarboxylic acid of said perylene tetracarboxylic dianhydride; heating the resulting tetracarboxylic acid; washing the dianhydride formed until the filtrate pH indicates substantially complete removal of the acid; and freeze drying said dianhydride; and an imaging member containing a supporting substrate, a photogenerating layer thereover, and a charge transport layer, and wherein the photogenerating layer is comprised of a perylene bisamide obtained from a substantially pure 3,4,9,10-perylene tetracarboxylic acid dianhydride.

The substrate can be formulated entirely of an electrically conductive material, or it can be comprised of an insulating material having an electrically conductive surface. The substrate can be of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects thereof. In a particularly preferred embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the electrophotoconductive member. Generally, the conductive layer ranges in thickness of from about 50 Angstroms to many centimeters, although the thickness can be outside of this range. When a flexible electrophotographic imaging member is desired, the thickness typically is from about 100 Angstroms to about 750 Angstroms. The substrate can be of any other conventional material, including organic and inorganic materials. Typical substrate materials include insulating nonconducting materials such as various resins known for this purpose including polycarbonates, polyamides, polyurethanes, paper, glass, plastic, polyesters, such as MYLAR® (available from E.I. DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

In embodiments, intermediate adhesive layers between the substrate and subsequently applied layers may be desirable to improve adhesion. When such adhesive layers are utilized, they preferably have a dry thickness of from about 0.1 micron to about 5 microns, although the thickness can be outside of this range. Typical adhesive layers include film-forming polymers such as polyester, polyvinylbutyral, polyvinylpyrrolidone, polycarbonate, polyurethane, polymethylmethacrylate, and the like as well as mixtures thereof. Since the surface of the substrate can be a metal oxide layer or an adhesive layer, the expression "substrate" as employed herein is intended to include a metal oxide layer with or without an adhesive layer on a metal oxide layer.

Specific examples of perylene photogenerating pigments of the present invention and encompassed by he formula illustrated herein include the photogenerating pigments, or compounds illustrated in Table 1, wherein the R groups refer to the R group in Formula 1a.

The photogenerating layer is of an effective thickness, for example of from about 0.05 micron to about 10 microns or more, and in embodiments has a thickness of from about 0.1 micron to about 3 microns. The thickness of this layer can be dependent primarily upon the concentration of photogenerating material in the layer, which may generally vary from about 5 to 100 percent. The 100 percent value generally occurs when the photogenerating layer is prepared by vacuum evaporation of the pigment. When the photogenerating material is present in a binder material, the binder generally contains from about 30 to about 95 percent by weight of the photogenerating material, and preferably contains about 40 to 80 percent by weight of the photogenerating material. Generally, it is desirable to provide this layer in a thickness sufficient to absorb about 90 to about 95 percent or more of the incident radiation which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired.

Charge transport layers are well known in the art. Typical transport layers are described, for example, in U.S. Pat. Nos. 4,265,990; 4,609,605; 4,297,424 and 4,921,773, the disclosures of each of these patents being totally incorporated herein by reference. Organic charge transport materials can also be employed. Typical charge, especially hole, transporting materials include the following.

Hole transport molecules of the type described in U.S. Pat. Nos. 4,306,008; 4,304,829; 4,233,384; 4,115,116; 4,299,897; 4,081,274, and 5,139,910, the disclosures of each of these patents being totally incorporated herein by reference, can be selected for the imaging members of the present invention. Typical diamine hole transport molecules include N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl -N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-(1,1'-biphenyl)-4,4'-diamine, N,N'-diphenyl-N,N'-bis(4-chlorophenyl)-(1,1'-biphenyl)-4,4'-diamine, N,N'-diphenyl-N,N'bis(phenylmethyl)-(1,1'-biphenyl)-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4 methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

In embodiments of the present invention, the preferred hole transport layer, since it enables excellent effective transport of charges, is comprised of the amines as illustrated in U.S. Pat. No. 4,265,990, the disclosure of which is totally incorporated herein by reference, and wherein X, Y and Z are selected from the group consisting of hydrogen, an alkyl group with, for example, from 1 to about 25 carbon atoms and a halogen, preferably chlorine, and at least one of X, Y and Z is independently an alkyl group or chlorine. When Y and Z are hydrogen, the compound may be named as N,N'-diphenyl-N,N'-bis(alkylphenyl)-(1,1'-biphenyl)-4,4'-diamine wherein alkyl is, for example, methyl, ethyl, propyl, n-butyl, or the like, or the compound may be N,N'-diphenyl-N,N'-bis(chlorophenyl)-(1,1'-biphenyl)-4,4'-diamine.

The charge transport material is present in the charge transport layer in an effective amount, generally from about 5 to about 90 percent by weight, preferably from about 20 to about 75 percent by weight, and more preferably from about 30 to about 60 percent by weight, although the amount can be outside of this range.

Examples of the highly insulating and transparent resinous components or inactive binder resinous material for the transport layer include materials, such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. Generally, the resinous binder contains from about 5 to about 90 percent by weight of the active material corresponding to the foregoing formula, and preferably from about 20 percent to about 75 percent of this material.

Similar binder materials may be selected for the photogenerating layer, including polyesters, polyvinyl butyrals, polyvinyl carbazole, polycarbonates, polyvinyl formals, poly(vinylacetals), and those illustrated in U.S. Pat. No. 3,121,006, the disclosure of which is totally incorporated herein by reference.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is of a thickness of less than 50 Angstroms to about 10 microns, preferably being no more than about 2 microns.

In addition, the photoconductive imaging member may also optionally contain an adhesive interface layer situated between the hole blocking layer and the photogenerating layer. This layer may comprise a polymeric material such as polyester, polyvinyl butyral, polyvinyl pyrrolidone and the like. Typically, this layer is of a thickness of less than about 0.6 micron.

Optionally, the as-synthesized photogenerating pigment can be post purified by methods such as train sublimation or using processes, such as those described in U.S. Pat. No. 5,225,307, the disclosure of which is totally incorporated herein by reference, which might convert it to a more photosensitive grade.

The photogenerating compounds of the present invention in embodiments thereof enable enhanced photosensitivity in the visible wavelength range. In particular, imaging members with photosensitivity at wavelengths of from about 400 to 700 nanometers are provided in embodiments of the present invention, which renders them particularly useful for color copying and imaging and printing applications, such as red LED and diode laser printing processes, which typically require sensitivity of about 600 to about 700 nanometers.

The present invention also encompasses a method of generating images with the photoconductive imaging members disclosed herein. The method comprises the steps of generating an electrostatic latent image on a photoconductive imaging member of the present invention, developing the latent image with a toner comprised of resin, pigment like carbon black, and a charge additive, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate may be by any method, including those making use of a corotron or a biased roll. The fixing step may be performed by means of any suitable method, such as flash fusing, heat fusing, pressure fusing, vapor fusing, and the like. Any material used in xerographic copiers and printers may be used as a substrate, such as paper, transparency material, and the like.

Specific embodiments of the invention will now be described in detail. These Examples are intended to be illustrative, and the invention is not limited to the materials, conditions, or process parameters set forth in these embodiments. All parts and percentages are by weight unless otherwise indicated.

PURIFICATION AND SYNTHESIS EXAMPLES

Perylene-3,4,9,10-tetracarboxylic acid dianhydride was purchased from BASF in 35 kilogram drums and is referred to herein as, for example, crude PTCDA. All solvents and reagents used were ACS reagent Grade or better. The amines used to prepare bisimides were commercially available from Aldrich, Pfaltz and Bauer and other suppliers, and were used as received. Temperatures are given in degrees Celsius. Freeze drying was carried out using a Labconco tray dryer. The structure and purity of products were determined using one or more of the following techniques: proton magnetic resonance spectroscopy in trifluoroacetic acid-d1/deuterochloroform (1:4 volume ratio); UV-VIS spectroscopy using trifluoroacetic acid/methylene chloride (1:4 volume ratio) solvent mixture; and elemental (CHN) analysis.

PURIFICATION OF PERYLENE-3,4,9,10-TETRACARBOXYLIC ACID DIANHYDRIDE

Crude PTCDA (500 grams, 1.275 mole) was stirred in 3,500 milliliters of deionized water containing 336 grams (5.10 mole) of potassium hydroxide (85 percent). The resulting mixture was stirred for 2 hours at room temperature, about 25° C., to give a dark yellow-brown solution. The solution was filtered through a 25 centimeters glass fiber filter (Whatman Grade GF/F) and the solid was washed with 2×100 milliliters portions of water. The filtration required 4 hours. The solid was dried at 600 for 24 hours to give 3.6 grams of fine black powder. This solid was insoluble in organic solvents. A 5 milligram sample was qualitatively analyzed using energy dispersive X-ray analysis using a scanning electron microscope which identified silicon, calcium and iron as the major elements present.

The filtrate was transferred to a 6 liter Erlenmeyer flask and was stirred and heated to 70° C., then was treated with 600 milliliters (6 mole) of concentrated hydrochloric acid. The mixture became very thick and it was diluted to 6 liters total volume with water to render it stirrable. The suspension was heated to 90° to 95° C. for 2 hours, then was cooled to 60° C. and was filtered through two 25 centimeter diameter glass fiber filters (Whatman Grade 934AH). The solid resulting was washed with water in the funnels with 500 milliliter portions of water until the filtrate pH reached 6 as measured using pH paper. A total of 6×500 milliliters washes were required for each filtration. The perylene acid dianhydride product was freeze dried for 5 days to provide 488 grams (97 percent yield) of a red substantially pure solid.

Thermogravimetric analysis of a sample of the product evidenced a weight loss of 0.46 percent at 250° C. and 0.53 percent at 400° C. The ash content measured following combustion of the purified pigment was undetectable. The ash content of the crude PTCDA was determined to be 0.37 percent. Other analyses evidenced that the purified pigment contained 367 ppm of sulfur and 63 ppm of iron. Similar analysis of a sample of crude PTCDA found 2,590 ppm of sulfur and 1,318 ppm of iron.

A second purification was accomplished under similar conditions, except that prior to the first filtration of the tetra acid salt, 100 grams of filter aid (Celite 521, Celite Corporation) were added, and the mixture was stirred for 10 minutes prior to filtration. The filtration was complete in about ½ hour compared to about 4 hours when no filter aid was used.

SYNTHESIS EXAMPLE I

N,N'-Bis(n-Propyl)perylene-3,4,9,10-bis(dicarboximide), Formula 1a, R=n-Propyl:

A suspension of 3.92 grams (0.010 mole) of pure PTCDA, obtained by the above process, in 200 milliliters of N-methylpyrrolidine (NMP) was treated with 5.90 grams (0.10 mole) of 1-aminopropane. The mixture was stirred and was heated to reflux at 202° C. A dark orange solution containing black crystals was obtained. After 40 minutes at reflux, the mixture was cooled to 150° C. and was filtered through a 9 centimeter glass fiber filter in a porcelain funnel which had been preheated with 50 milliliters of boiling dimethylformamide (DMF). The solid was washed in the funnel with 3×50 milliliters portions of boiling DMF. The initial filtrate was dark brown; the final boiling DMF wash was a light orange color. The solid was washed in the funnel with 25 milliliters of cold DMF, then with 3×20 milliliter portions of methanol, and was dried at 60° C. for 6 hours to provide 4.1 grams (86 percent) of the bis(propylimide) as shiny black needle crystals. Elemental analysis: C, 76.38; H, 4.78; N, 5.81. Calculated for $C_{30}H_{22}N_2O_4$: C, 75.95; H, 4.67; N, 5.90.

Proton magnetic resonance analysis of a 10 milligram sample of the above obtained product dissolved in 1 milliliter of a 1:2 mixture (by volume) of trifluoroacetic acid-d1 and deuterochloroform using a 300 Megahertz instrument indicated that the sample was between 99 to 100 percent pure, there being no detectable impurities in the spectrum.

COMPARATIVE SYNTHESIS EXAMPLE I

N,N'-Bis(n-Propyl)perylene-3,4,9,10-bis(dicarboximide), Formula 1a, R=n-Propyl:

PTCDA (Crude, 7.84 grams, 0.020 mole) and n-propylamine (5.90 grams, 0.10 mole) were stirred in 300 milliliters of NMP. The suspension was heated to reflux (202° C.) for 5 minutes, then was cooled to 150° C. and was filtered through a preheated (boiling DMF) 11 centimeters glass fiber filter. The solid was washed in the funnel with boiling DMF (about 300 milliliters) until the filtrate remained a faint orange color. The solid was washed with cold DMF (50 milliliters) then methanol (3×50 milliliters) and was dried at 700° C. to yield 8.6 grams (91 percent) of the bisimide as black crystals. Elemental Analysis: C, 75.39; H, 4.51; N, 5.85. Calculated for $C_{30}H_{22}N_2O_4$: C, 75.94; H, 4.67; N, 5.90.

Proton magnetic resonance analysis indicated that this sample contained no detectable impurities. When this compound was selected as a photogenerating pigment in a layered photoconductive imaging member, high print deletion and low charge acceptance were measured.

SYNTHESIS EXAMPLE II

N,N'-Bis(3-methoxypropyl)perylene-3,4,9,10-bis (dicarboximide, Formula 1a, R=3-Methoxypropyl:

Pure PTCDA (3.92 grams, 0.010 mole) and 3-methoxypropylamine (4.45 grams, 0.050 mole) were stirred in 200 milliliters of NMP and heated to reflux (202° C.) for 1 ½ hours. The resultant dark orange-brown solution was cooled to 150° C. and was filtered through a preheated funnel. The solid was washed with boiling DMF, about 4×50 milliliters, until the filtrate remained a light orange color. The solid was washed with 50 milliliters of DMF and 3×25 milliliters portions of methanol, then was dried at 60° C. to provide 4.5 grams (84 percent) of the bisimide as shiny black needle crystals.

COMPARATIVE SYNTHESIS EXAMPLE 2

N,N'-Bis(3-methoxypropyl)perylene-3,4,9,10-bis (dicarboximide) Formula 1a, R=3-Methoxypropyl:

Crude PTCDA (15.6 grams, 0.040 mole) and 3-methoxypropylamine (27 grams, 0.30 mole) were stirred and heated in 800 milliliters of DMF. The mixture was allowed to reflux (202° C.) for 5 minutes, then was cooled to 150° C. and was filtered through a 350 milliliters D-porosity sintered glass funnel which had been preheated with boiling DMF. The solid was washed in the funnel with about 200 milliliters of boiling DMF until the filtrate became a light orange . The solid was washed with 50 milliliters of cold DMF and 3×50 milliliters of methanol, then was dried at 60° C. to provide 19.5 grams (91 percent) of shiny dark brown solid.

SYNTHESIS EXAMPLE III

N,N'-Bis(n-pentyl)perylene-3,4,9,10-bis(dicarboximide), Formula 1a, R=n-Pentyl

A mixture of pure PTCDA (7.84 grams, 0.020 mole) and n-amylamine (8.72 grams, 11.6 milliliters, 0.10 mole) in 300 milliliters of NMP was stirred and heated to reflux for 30 minutes. The solution was cooled to 120° C. and was filtered through a preheated 9 centimeter glass fiber filter which had been preheated with DMF at 120° C. The solid was washed with 3×50 milliliters portions of DMF at 120° C., then with 50 milliliters of cold DMF and 2×25 milliliters portions of methanol. Drying at 60° C. gave 8.7 grams (82 percent) of the bisimide as shiny black crystals. Elemental analysis: Calculated for $C_{34}H_{30}N_2O_4$: C, 76.96; H, 5.70; N, 5.28. Found: C, 76.76; H, 5.66; N, 5.44.

COMPARATIVE SYNTHESIS EXAMPLE 3

N,N'-Bis(n-pentyl)perylene-3,4,9,10-bis(dicarboximide), Formula 1a, R=n-Pentyl:

Crude PTCDA (8.0 grams, 0.0204 mole) and n-amylamine (20 grams, 0.23 mole) and NMP were stirred and heated to reflux at 202° C. for 30 minutes. The solution was cooled to 150° C. and was filtered through a preheated 350 milliliter sintered glass funnel. The solid was washed with 3×100 milliliters of boiling DMF, then with 50 milliliters of cold DMF and 3×25 milliliters of methanol. The solid perylene product was dried at 60° C. to provide 6.48 grams (60 percent) of the bisimide as a fluffy, dark brown solid.

SYNTHESIS EXAMPLE IV

N,N'-(bisbenzyl)perylene-3,4,9,10-bis(dicarboximide), Formula 1a, R=Benzyl:

Pure PTCDA (3.92 grams, 0.010 mole) and benzylamine (5.4 grams, 0.050 mole) were stirred and heated at reflux (202° C.) in 200 milliliters of NMP for 1 hour. The resultant suspension was cooled to 150° C. and was filtered through a 150 milliliter M-porosity sintered glass funnel which had been preheated with boiling DMF. The resulting solid was washed in the funnel with 3×50 milliliters portions of boiling DMF, then with 50 milliliters of cold DMF followed by 3×25 milliliters of methanol. The solid was dried at 600 to give the bis(benzylimide) as a brown solid (5.2 grams, 91 percent).

COMPARATIVE SYNTHESIS EXAMPLE 4

N,N'-(bisbenzyl)perylene-3,4,9,10-bis(dicarboximide), Formula 1a, R=Benzyl:

The above synthesis was repeated except that crude PTCDA was used instead of pure PTCDA. The yield of bis(benzylimide) was 5.2 grams (91 percent).

SYNTHESIS EXAMPLE V

N,N'-bis(3-chlorobenzyl)perylene-3,4,9,10-bis (dicarboximide), Formula 1a, R=3-Chlorobenzyl:

Purified PTCDA (3.92 grams, 0.010 mole) and 3-chlorobenzylamine (4.25 grams, 0,030 mole) were stirred and heated in 200 milliliters of NMP. After 1 hour at reflux, the mixture was cooled to 150° C. and was filtered and washed with boiling DMF, cold DMF and methanol, and was dried at 600 to give 5.8 grams (91 percent) of the diimide as fluffy black solid.

COMPARATIVE SYNTHESIS EXAMPLE 5

N,N'-bis(3-chlorobenzyl)perylene-3,4,9,10-bis (dicarboximide), Formula 1a, R=3-Chlorobenzyl:

A mixture of 39.2 grams (0.10 mole) of crude perylene-3,4,9,10-tetracarboxylic acid dianhydride and 70.8 grams (0.50 mole) of 3-chlorobenzylamine in 1,500 milliliters of NMP was stirred and warmed to reflux in a 2 liter Erlenmeyer flask. The red suspension turned dark brown and became viscous at 140° C., and was black at 170° C. The mixture was heated to its reflux temperature (202° C.) for 5 minutes, then was cooled to 155° C. with stirring. The mixture was filtered through a preheated (boiling DMF) 2 liter sintered glass funnel, and the solid was washed with boiling DMF (3×400 milliliters) until the filtrate became a clear light orange color. The solid was stirred in 500 milliliters of boiling DMF and the mixture was filtered. The solid was washed with 2×200 milliliters of DMF, then with 2×200 milliliters of methanol, and was dried at 60° C. to provide 59.7 grams (93.4 percent) of bis(3-chlorobenzylimido)perylene as fluffy, jet black crystals. The product, in a $10^{-4}$ molar 96 percent sulfuric acid solution, had visible absorption peaks at about 600 and 555 nanometers typical of a perylene bisimide pigment.

A thin film of about 1 micron thick containing about 70 percent by weight of the above prepared pigment, which had been finely ground on a ball mill and dispersed in a poly (vinyl acetate) binder according to the procedure described by R. Loutfy, *Can. J. Chem.* 59, 544, (1981), the disclosure of which is totally incorporated herein by reference, showed a broad spectral absorption band centered at 428 nanometers, which extended to about 350 nanometers in the UV, and a second broad band at 674 nanometers which extended to beyond about 730 nanometers in the infrared.

The X-ray powder diffraction pattern of this pigment showed peaks at the following 2-theta angles (relative peak intensities are in parentheses): 5.3 (31), 9.4 (22), 12.2 (100), 16.1 (14), 20.9 (19), 22.3 (12), 22.6 (13), 24.8 (21), 25.4 (48), 26.3 (13), 26.8 (21) degrees.

SYNTHESIS EXAMPLE VI

N,N'-bis(3-methoxybenzyl)perylene-3,4,9,10-bis (dicarboximide), Formula 1a, R=3-Methoxybenzyl:

Pure PTCDA (3.92 grams, 0.010 mole) and 3-methoxybenzylamine (6.82 grams, 0.050 mole) were stirred and heated in 200 milliliters of NMP. The mixture was held at reflux (202° C.) for 40 minutes, then was cooled to 150° C. and was filtered through a preheated funnel. The solid was washed in the funnel with 3×50 milliliters of boiling DMF, then with 50 milliliters of cold DMF and 2×25 milliliters of methanol. The solid was dried at 60° C. to give 5.8 grams (92 percent) of the bisimide as fine black solid.

COMPARATIVE SYNTHESIS EXAMPLE 6

N,N'-bis(3-methoxybenzyl)perylene-3,4,9,10-bis (dicarboximide), Formula 1a, R=3-Methoxybenzyl:

The above Example VI was repeated using crude PTCDA to provide 5.9 grams (94 percent) of the bis(3-methoxybenzylimide).

SYNTHESIS EXAMPLE VII

N,N'-bis(4-methoxybenzyl)perylene-3,4,9,10-bis (dicarboximide), Formula 1a, R=4-Methoxybenzyl:

Pure PTCDA (3.92 grams, 0.0010 mole) and 4-methoxybenzylamine (6.86 grams, 0.005 mole) were stirred and heated in 200 milliliters of NMP. After 45 minutes at reflux (202° C.), the resultant black suspension was cooled to 150° C., then was filtered through a preheated 150 milliliter M-porosity sintered glass funnel which had been preheated with boiling DMF. The solid was washed with 3×50 milliliters portions of boiling DMF then with 25 milliliters of cold DMF followed by 3×25 milliliters portions of methanol. The solid (product throughout) was dried at 60 to give 6.0 grams (97 percent) of the bisimide as fine jet black solid.

COMPARATIVE SYNTHESIS EXAMPLE 7

N,N'-bis(4-methoxybenzyl)perylene-3,4,9,10-bis (dicarboximide), Formula 1a, R=4-Methoxybenzyl:

Crude PTCDA (4.0 grams, 0.0102 mole) and 4-methoxybenzylamine (10.0 grams, 0.0730 mole) were stirred and heated to reflux in 200 milliliters of NMP. After 1 hour at reflux, the suspension was cooled to 150° C., and the mixture was filtered through a preheated sintered glass funnel. The solid was washed with 3×50 milliliters of boiling DMF followed by 25 milliliters of cold DMF then 3×25 milliliters of methanol. The solid was dried to give 6.1 grams (98 percent) of the bis(4-methoxybenzylimide) as a fluffy jet black solid.

SYNTHESIS EXAMPLE VIII

N,N'-bis(phenethyl)perylene-3,4,9,10-bis(dicarboximide), Formula 1a, R=Phenethyl:

Pure PTCDA (7.84 grams, 0.020 mole) and phenethylamine (12.2 grams, 0.10 mole) were combined in 400 milliliters of NMP and the mixture was stirred and heated at reflux (202° C.) for 40 minutes. The resultant black suspension was cooled to 150° C., then was filtered through a preheated 11 centimeter glass fiber filter. The solid was washed on the funnel with 3×100 milliliters portions of boiling DMF, then with 50 milliliters of cold DMF and 3×50 milliliters of methanol. The solid was dried at 600 to give the desired bis(phenethylimide) as a fluffy black solid (10.3 grams, 86 percent).

COMPARATIVE SYNTHESIS EXAMPLE 8

N,N'-bis(phenethyl)perylene-3,4,9,10-bis(dicarboximide), Formula 1a, R=Phenethyl:

Example VIII was repeated with crude PTCDA in place of the pure PTCDA and there resulted 10.9 grams (91 percent) of bisimide.

ASH DETERMINATION OF SELECTED SAMPLES

To illustrate the effect of purification of PTCDA on the purity of the above bisimides, eight selected samples were submitted for ash determination. The results, which are tabulated below, indicate that the ash content of the bisimides prepared from purified PTCDA was substantially lower, ranging from about 40 percent to about 10 percent less than that of the bisimides prepared from crude PTCDA.

| SAMPLE NUMBER | PERCENT OF ASH |
|---|---|
| Synthesis Example I (Bis-n-propylimide) | 0.022 |
| Comparative Synthesis Example 1 | 0.320 |
| Synthesis Example II (Bis-3-methylpropylimide) | 0.025 |
| Comparative Synthesis Example 2 | 0.290 |
| Synthesis Example III (Bis-n-pentylimide) | 0.022 |
| Comparative Synthesis Example 3 | 0.144 |
| Synthesis Example V (Bis-3-chlorobenzylimide) | 0.273 |
| Comparative Synthesis Example 5 | 0.120 |

XEROGRAPHIC ELECTRICAL EVALUATION

Photoresponsive imaging members were fabricated with the perylene pigments obtained by Synthesis Examples I to VIII and Comparative Synthesis Examples 1 to 8. These photoresponsive imaging members are generally known as dual layer photoreceptors containing a photogenerator layer, and thereover a charge transport layer. The photogenerator layer was prepared from a pigment dispersion as follows: 0.2 gram of the perylene pigment was mixed with 0.05 gram of polyvinylcarbazole (PVK) polymer and 8.1 milliliters of methylene chloride in a 30 milliliter glass bottle containing 70 grams of ⅛-inch stainless steel balls. The bottle was placed on a roller mill and the dispersion was milled for 4 days. Using a film applicator of 1.5 mil gap, the pigment dispersion was coated to form the photogenerator layer on a titanized MYLAR™ substrate of 75 microns in thickness, which had a silane layer 0.1 micron in thickness thereover, E.I. DuPont 49,000 polyester adhesive thereon in a thickness of 0.1 micron. Thereafter, the photogenerator layer formed was dried in a forced air oven at 135° C. for 20 minutes. Photogenerator layers for each device were each overcoated with an amine charge transport layer prepared as follows. A transport layer solution was made by mixing 8.3 grams of MAKROLON™ , a polycarbonate resin, 4.4 grams of N,N'-diphenyl-N,N'-bis(3-methylphenyl)-(1,1'-biphenyl)-4,4'-diamine and 82.3 grams of methylene chloride. The solution was coated onto the above photogenerating layer using a film applicator of 10 mil gap. The resulting member was dried at 135° C. in a forced air oven for 20 minutes. The final dried thickness of transport layer was 20 microns.

The xerographic electrical properties of each imaging member were then determined by electrostatically charging its surface with a corona discharging device until the surface potential, as measured by a capacitively coupled probe attached to an electrometer, attained an initial value $V_0$. After resting for 0.5 second in the dark, the charged member reached a surface potential of $V_{ddp}$, dark development potential, and was then exposed to the monochromatic light of wavelength 500 nanometers from a filtered xenon lamp. A reduction in the surface potential to $V_{bg}$, background potential due to photodischarge effect, was observed. The dark decay in volt/second was calculated as $(V_o-V_{ddp})/0.5$.

The lower the dark decay value, the better is the ability of the member to retain its charge prior to exposure by light. Similarly, the lower the $V_{ddp}$, the poorer is the charging behavior of the member. The percent photodischarge was calculated as $100\times(V_{ddp}-V_{bg})N_{ddp}$. The light energy used to photodischarge the imaging member during the exposure step was measured with a light meter. The photosensitivity of the imaging member can be described in terms of $E_{1/2}$, the amount of exposure energy in erg/cm$^2$ required to achieve 50 percent photodischarge from the dark development potential. The higher the photosensitivity, the smaller is the $E_1/_2$ value. High photosensitivity (lower $E_{1/2}$ value), lower dark decay and high charging are desired for the improved performance of xerographic imaging members.

The charge acceptance property of photoreceptor devices was assessed by measuring the surface potential $V_{ddp}$ when the devices were subjected to the same charging conditions. For comparison purpose, the corotron voltage was set at 5.0 kV and the surface potentials of photoreceptors prepared from pigments synthesized were determined, which are summarized in Table 2.

TABLE 2

Charge Acceptance Property of Perylene Bisimides

| R Group | Example | PTCDA | Vddp, volts |
|---|---|---|---|
| n-Propyl | Synthesis 1 | Purified | 800 |
| " | Comp. Synth. 1 | Crude | 400 |
| 3-Methoxypropyl | Synthesis 2 | Purified | 800 |
| " | Comp. Synth. 2 | Crude | 400 |
| n-Pentyl | Synthesis 3 | Purified | 800 |
| " | Comp. Synth. 3 | Crude | 400 |
| Benzyl | Synthesis 4 | Purified | 800 |
| " | Comp. Synth. 4 | Crude | 400 |
| 3-Chlorobenzyl | Synthesis 5 | Purified | 800 |
| " | Comp. Synth. 5 | Crude | 400 |
| 3-Methoxybenzyl | Synthesis 6 | Purified | 800 |
| " | Comp. Synth. 6 | Crude | 400 |
| 4-Methoxybenzyl | Synthesis 7 | Purified | 800 |
| " | Comp. Synth. 7 | Crude | 400 |
| Phenethyl | Synthesis 8 | Purified | 800 |
| " | Comp. Synth. 8 | Crude | 400 |

All perylene bisimides prepared from crude PTCDA (Comparative Synthesis Examples 1 to 8) displayed a 50 percent lower charge retention compared to their perylene bisimide counterparts prepared from purified PTCDA. In the Examples disclosed, perylene bisimides generated from purified PTCDA have improved enhanced charge acceptance properties compared to perylene bisimides prepared from crude PTCDA. It appears that some unknown impurities in the crude PTCDA were carried into the final perylene bisimides, and caused a degradation of the charging property of photoreceptors prepared from such perylene pigments.

In view of the excellent charging properties, the complete xerographic evaluation of perylene bisimides synthesized from purified PTCDA were further determined and the results are shown in Table 3. The photoreceptors exhibited excellent photosensitivity and the values of half-exposure energy $E_{1/2}$ in the range of 6 to 13 erg/cm$^2$.

TABLE 3

Xerographic Evaluation of Bisimides Synthesized Using Perylene tetracarboxylic Acid Dianhydride (PTCDA) "R-Group" Refers to the R in Formula 1a.

| R-Group | Example | PTCDA | $V_{ddp}$ (−V) | Dark Decay [500 ms] (V) | $E_{1/2}$ (ergs/cm$^2$) |
|---|---|---|---|---|---|
| n-Propyl | Synthesis 1 | Purified | 800 | 6.9 | 6.2 |
| 3-Methoxypropyl | Synthesis 2 | Purified | 800 | 5.5 | 9.8 |
| n-Pentyl | Synthesis 3 | Purified | 800 | 3.1 | 7.0 |
| Benzyl | Synthesis 5 | Purified | 800 | 3.8 | 10.9 |
| 3-Chlorobenzyl | Synthesis 6 | Purified | 800 | 11.5 | 8.0 |
| 3-Methoxybenzyl | Synthesis 4 | Purified | 800 | 3.7 | 12.6 |
| 4-Methoxybenzyl | Synthesis 7 | Purified | 800 | 14.5 | 13.1 |
| Phenethyl | Synthesis 8 | Purified | 800 | 7.3 | 9.4 |

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the purification of 3,4,9,10-perylene tetra carboxylic acid dianhydride comprising the dissolution of said anhydride in an amine solution at from about 25° C. to about 90° C.; filtration of the resultant solution through a fine porosity filter with a pore size of from about 0.1 to about 1 micron, primarily to remove colloidal black contaminants present in a amount of from about 0.5 to about 1.5 weight percent of the dianhydride; converting the salt formed to 3,4,9,10-perylene tetracarboxylic acid by acidifying the solution with hydrochloric acid, and thereafter heating the resulting suspension at from about 75° C. to about 100° C. to form 3,4,9,10-perylene tetracarboxylic acid dianhydride; filtering and washing the anhydride formed with water until the filtrate pH is from about 6 to about 7; and freeze drying the resulting wet filter cake to provide 3,4,9,10-perylene tetracarboxylic acid dianhydride.

2. A process for the purification of 3,4,9,10-perylene tetracarboxylic acid dianhydride consisting of the dissolution of said acid dianhydride in an aqueous alkali metal hydroxide solution at from about 25° C. to about 90° C.; filtration of the resultant solution through a fine porosity filter with a pore size of from about 0.1 to about 1 micron, primarily to remove colloidal black contaminants present in an amount of from about 0.5 to about 1.5 weight percent of the dianhydride; converting the alkali metal salt formed to 3,4,9,10-perylene tetracarboxylic acid by acidifying the solution with hydrochloric acid, and thereafter heating the resulting suspension at from about 75° C. to about 100° C. to form 3,4,9,10-perylene tetracarboxylic acid dianhydride; filtering and washing the anhydride formed with water until the filtrate pH is from about 6 to about 7, and which pH indicates complete removal of the acid; and freeze drying the resulting wet filter cake to provide substantially pure 3,4,9,10-perylene tetracarboxylic acid dianhydride.

3. A process for the purification of 3,4,9,10-perylene tetracarboxylic acid dianhydride comprising the dissolution of said acid dianhydride in an aqueous alkali metal hydroxide solution at from about 25° C. to about 90° C.; filtration of the resultant solution through a fine porosity filter with a pore size of from about 0.1 to about 1 micron, primarily to remove colloidal black contaminants present in an amount of from about 0.5 to about 1.5 weight percent of the dianhydride; converting the alkali metal salt formed to 3,4,9,10-perylene tetracarboxylic acid by acidifying the solution with hydrochloric acid, and thereafter heating the resulting suspension at from about 75° C. to about 100° C. to form 3,4,9,10-perylene tetracarboxylic acid dianhydride; filtering and washing the anhydride formed with water until the filtrate pH is from about 6 to about 7, and which pH indicates complete removal of the acid; and freeze drying the resulting wet filter cake to provide substantially pure 3,4,9,10-perylene tetracarboxylic acid dianhydride.

4. A process in accordance with claim 3 wherein prior to said filtration of the resultant solution there is added to said solution a suitable filter component.

5. A process in accordance with claim 3 wherein the dianhydride is present in an amount of from about 2 parts to about 30 parts, the water is present in an amount of from about 98 parts to about 70 parts, the alkali metal hydroxide is potassium hydroxide present in an amount corresponding to from about 3 molar equivalents to about 10 molar equivalents of the dianhydride and the hydrochloric acid is added from about an equimolar amount to about 4 molar equivalents of the potassium hydroxide.

6. A process in accordance with claim 3 wherein the dianhydride is present in an amount of from about 10 parts to about 20 parts, the water is present in an amount of from about 90 parts to about 80 parts, the alkali metal hydroxide is potassium hydroxide present in an amount corresponding to from about 4 molar equivalents to about 5 molar equivalents of the dianhydride, and the hydrochloric acid is selected in an amount of from about one molar equivalent to about 2 molar equivalents of the potassium hydroxide.

7. A process in accordance with claim 3 wherein the alkali metal hydroxide is potassium hydroxide, sodium hydroxide, or lithium hydroxide.

8. A process in accordance with claim 1 wherein the amine is selected and is a tertiary organic amine of trimethylamine, triethylamine or tripropylamine.

9. A process in accordance with claim 3 wherein the dissolution of the dianhydride in the aqueous alkali solution is accomplished over a time of from about 15 minutes to about 24 hours, and wherein said alkali solution contains potassium hydroxide.

10. A process in accordance with claim 3 wherein the purity of the product is from about 98 percent to about 99.4 percent, there being no detectable ash measured by combustion analysis, and wherein the amount of volatile contaminants released when a sample of said product is heated to about 400° C. as measured by thermogravimetric analysis is less than about 0.6 percent.

11. A process in accordance with claim 3 wherein the product contains from 0 to about 500 ppm of sulfur and from 0 to about 100 ppm of iron.

12. A process in accordance with claim 1 wherein said perylene tetracarboxylic acid dianhydride is perylene-3,4,9,10-tetracarboxylic acid dianhydride and is reacted with a primary amine in a refluxing high boiling reaction solvent, followed by filtering the resultant bisimide; washing the product with hot wash solvent, which solvent is at a temperature of from about 60° C. to about 155° C.; washing the resulting solid with a low boiling final wash solvent, which solvent possesses a boiling point of from about 50° C. to about 80° C.; and drying the product.

13. A process in accordance with claim 12 wherein the anhydride is present in an amount of from about 1 part to about 20 parts, the refluxing reaction solvent is present in an amount of from about 99 to about 80 parts, and the primary amine is present in an amount corresponding to about 2 to about 20 equivalents of the anhydride; or wherein the anhydride is present in an amount of from about 2 part to 5 parts, the reaction solvent is present in an amount of from about 98 to about 95 parts, and the primary amine is present in an amount corresponding to about 2.5 to about 5 equivalents of the anhydride.

14. A process in accordance with claim 12 wherein the reaction solvent is dimethylformamide, or N-methylpyrrolidone, the hot wash solvent is dimethylformamide wherein hot is at a temperature of from about 60° C. to about 155° C., and wherein the final wash solvent is methanol.

15. A process in accordance with claim 12 wherein the amine is n-propylamine, 3-methoxypropylamine, 3-chlorobenzylamine, 3-methoxybenzylamine, 4-methoxybenzylamine, 2-phenethylamine, 3,5-dimethylbenzylamine, or 3,5-dichlorobenzylamine.

16. A process in accordance with claim 12 wherein subsequent to washing the resulting solid with a low boiling final wash solvent, which solvent possesses a boiling point of from about 50° C. to about 80° C.; cooling is accomplished and the product is perylene-3,4,9,10-tetracarboxylic acid dianhydride.

17. A process in accordance with claim 3 wherein there results a high purity product, and which purity is from about 98 to about 99.5 percent.

18. A member in accordance with claim 2 containing a supporting substrate and a charge transport layer, and wherein the perylene is a substantially pure 3,4,9,10-perylene tetracarboxylic acid dianhydride.

19. A photoconductive imaging member comprised of a photogenerating layer comprised of a perylene bisamide obtained from a perylene tetracarboxylic acid dianhydride, and which dianhydride is prepared by the dissolution of said acid dianhydride in an aqueous alkali metal hydroxide solution; filtration of the resultant solution through a fine porosity filter with a pore size of from about 0.1 to about 1 micron; converting the alkali metal salt formed to 3,4,9,10-perylene tetracarboxylic acid, and thereafter heating the resulting suspension to form 3,4,9,10-perylene tetracarboxylic acid dianhydride.

* * * * *